US007137460B2

(12) United States Patent
Slaughter, Jr. et al.

(10) Patent No.: US 7,137,460 B2
(45) **Date of Patent: *Nov. 21, 2006**

(54) BACK REAMING TOOL

(75) Inventors: Robert H. Slaughter, Jr., Ponca City, OK (US); Peter T. Cariveau, Ponca City, OK (US); Vincent W. Shotton, Ponca City, OK (US)

(73) Assignee: Smith International, Inc., Houston, TX (US)

( * ) Notice: Subject to any disclaimer, the term of this patent is extended or adjusted under 35 U.S.C. 154(b) by 288 days.

This patent is subject to a terminal disclaimer.

(21) Appl. No.: 10/803,171

(22) Filed: Mar. 17, 2004

(65) Prior Publication Data

US 2004/0188141 A1 Sep. 30, 2004

Related U.S. Application Data

(63) Continuation-in-part of application No. 10/075,052, filed on Feb. 12, 2002, now Pat. No. 6,729,418.

(60) Provisional application No. 60/268,303, filed on Feb. 13, 2001.

(51) Int. Cl.
*E21B 9/22* (2006.01)

(52) U.S. Cl. ..... 175/53; 175/385; 175/406

(58) Field of Classification Search ..... 175/53, 175/61, 385, 406
See application file for complete search history.

(56) References Cited

U.S. PATENT DOCUMENTS

| | | | | |
|---|---|---|---|---|
| 4,036,313 | A * | 7/1977 | Dixon et al. | 175/344 |
| 4,136,748 | A * | 1/1979 | Dickerhoff | 175/337 |
| 6,729,418 | B1 * | 5/2004 | Slaughter et al. | 175/53 |
| 2002/0088649 | A1 * | 7/2002 | Morris et al. | 175/334 |

* cited by examiner

*Primary Examiner*—William Neuder
(74) *Attorney, Agent, or Firm*—Osha Liang LLP

(57) ABSTRACT

A back reaming tool is disclosed which includes a tool body adapted to be coupled to a drill string, and at least cutting structure mounted to a leg and having cutting elements disposed thereon. The leg is removably coupled to the tool body.

19 Claims, 10 Drawing Sheets

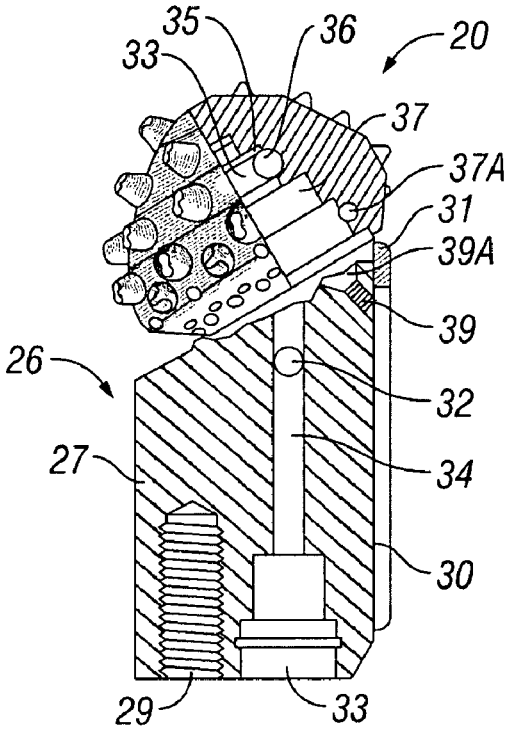
FIG. 4
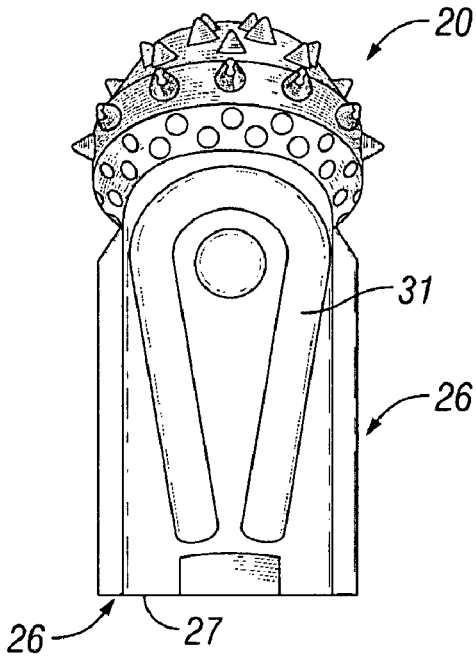
FIG. 5
FIG. 4A
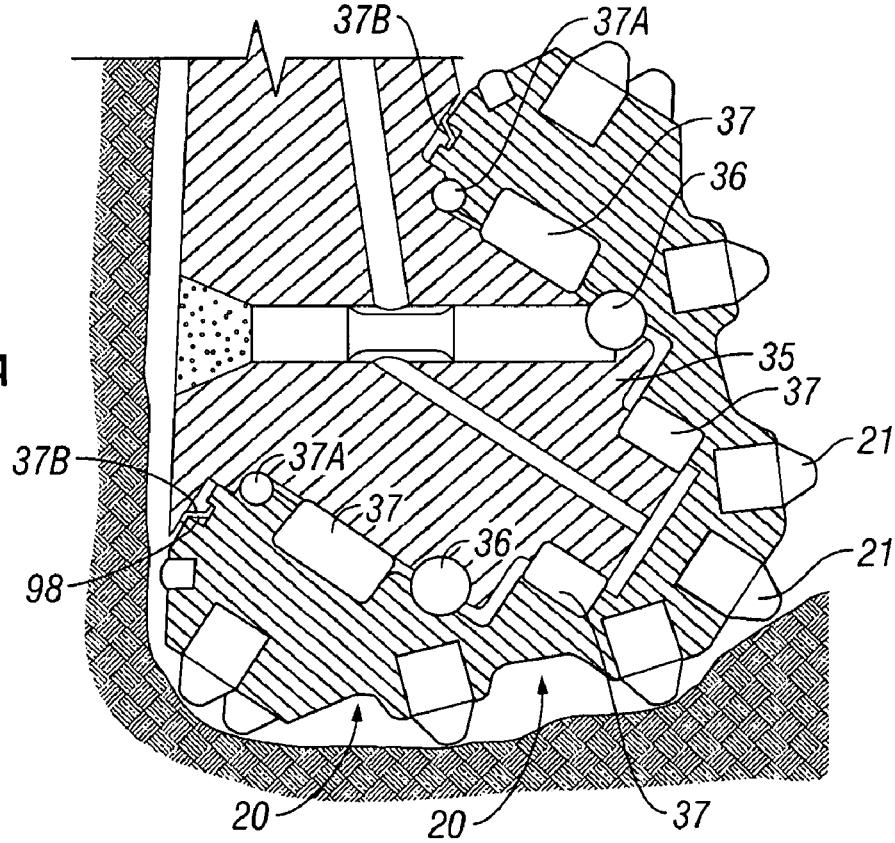

BACK REAMING TOOL

CROSS-REFERENCE TO RELATED APPLICATIONS

This application claims priority, pursuant to 35 U.S.C. §119(e), to U.S. Provisional Application No. 60/268,303 filed on Feb. 13, 2001. Further, this application is a continuation-in-part to U.S. patent application Ser. No. 10/075,052, filed on Feb. 12, 2002 now U.S. Pat. No. 6,729,418 (which also claims priority to the above provisional application) and claims the benefit, pursuant to 35 U.S.C. §120. Those applications are incorporated by reference in their entirety.

BACKGROUND OF INVENTION

1. Field of the Invention

The invention is related to the field of wellbore drilling. More specifically, the invention is related to tools used in back reaming operations, such as used to create boreholes river crossing and similar horizontal drilling applications.

2. Background Art

Horizontal directional drilling (HDD) is a technique used to create subsurface conduits underneath roadways, river beds or other obstructions in the path of things such as petroleum product pipelines and communication cable passageways.

Typically, a specialized drilling rig, such as one sold under the trade name DITCH WITCH by the Charles Machine Works, Inc. Perry, Okla., is used to drill the subsurface conduits. An entry hole is bored at the earth's surface on one side of the obstruction, using a steerable drilling head attached to one end of a drill string. The drill string is generally made of a number of segments or "joints" of threadedly coupled drill pipe. The entry hole is started at an angle slightly inclined from horizontal so that the conduit will become increasingly deeper in the ground as the conduit extends laterally away from the surface position of the entry hole. When the conduit reaches a sufficient depth, the conduit is drilled substantially horizontally until it crosses the lateral surface position of the obstruction. Then drilling proceeds in a slightly upward direction, continuing laterally away from the obstruction, to terminate the conduit at an exit hole on the earth's surface on the other side of the obstruction.

To complete the conduit, a service cable or pipe is attached to the exposed end of the drill string at the exit hole, and is pulled back to the drilling rig along with the drill string. Often, the conduit driller or operator may wish to increase the diameter from that initially drilled during the directional drilling operation. A device known as a back reaming tool is coupled to the end of the drill string to perform this enlargement as the drill string is withdrawn from the conduit. Several different types of back reaming tools are known in the art.

A first type of back reaming tool is formed from a roller cone drill bit of a type used to initially drill the conduit, or of a type used in petroleum and mining wellbore drilling operations. In such roller cone bit type back reaming tools, roller cones are disposed so that their cutting ends face the drilling rig from the exit hole. As the drill string is withdrawn from the conduit, the drill string is rotated so that roller cones on the back reaming tool will cut the walls of the conduit to enlarge the conduit diameter. Drill bit type back reaming tools are essentially an improvisation, and while they have proven commercially successful, they have limited application because of the difficulty in making them and the fact that once any of the cutting elements, any one of the roller cones, or any of the rotary bearing structures on the roller cones wear out or fail, the entire reaming tool must be replaced.

Another type of back reaming tool is intentionally designed as a back reaming tool, and includes a reaming tool body, to which are removably attached a plurality of cutting structures. Each one of the cutting structures includes a roller cone rotatably mounted on a bearing journal. In one embodiment of a back reaming tool known in the art, the bearing journal is removably mounted at both ends thereof in a cradle. The cradle is removably mounted to the tool body. In another embodiment of a back reaming tool known in the art, the bearing journal is threadedly coupled at one end to the cradle. A common aspect of the back reaming tools known in the art is that they include roller cone cutting structures which are exposed to wellbore fluids at both axial ends. Therefore, the back reaming tools known in the art require that the bearings be sealed in two places along the axis of the bearing journal to exclude wellbore fluids and maintain adequate bearing life. Another aspect common to back reaming tools known in the art is that they include a plurality of roller cones rotatably mounted on the tool body. Limitations on the minimum useful size of the bearing journal limits the diameter of conduits which may use such back reaming tools. Another aspect common to back reaming tools known in the art is that they use roller cones for the cutting elements thereon.

SUMMARY OF INVENTION

One aspect of the invention is a back reaming tool which includes a tool body adapted to be coupled to a drill string, and at least one roller cone rotatably mounted to a leg and having cutting elements disposed thereon. The leg is removably coupled to the tool body. The at least one roller cone is open at only one axial end thereof.

Another aspect of the invention is a back reaming tool which includes a tool body adapted to be coupled to a drill string, and a single roller cone rotatably mounted to a journal affixed to the tool body in a direction adapted to enlarge a diameter of a wellbore as the drill string and tool body coupled thereto are rotated and withdrawn from the wellbore. One embodiment of the invention includes a single roller cone open only at one end. One embodiment according to this aspect of the invention includes a cone retainer adapted to hold the cone on the tool body in the event of bearing failure. Another embodiment according to this aspect of the invention includes a journal retainer adapted to contact one end of the journal and being removably affixed to the tool body. In one embodiment, the journal is removably affixed to the tool body when the journal retainer is removed from the tool body.

BRIEF DESCRIPTION OF DRAWINGS

FIG. 4 shows a cross-section of one of the cutting structures of the example back reaming tool shown in FIG. 2.

FIG. 4A shows a closer view of the cross-section of the cutting structure shown in FIG. 4.

FIG. 5 shows a side view of the cutting structure of FIG. 4 to show an example of gage protection applied to an outer surface thereof.

DETAILED DESCRIPTION

Figure 1:
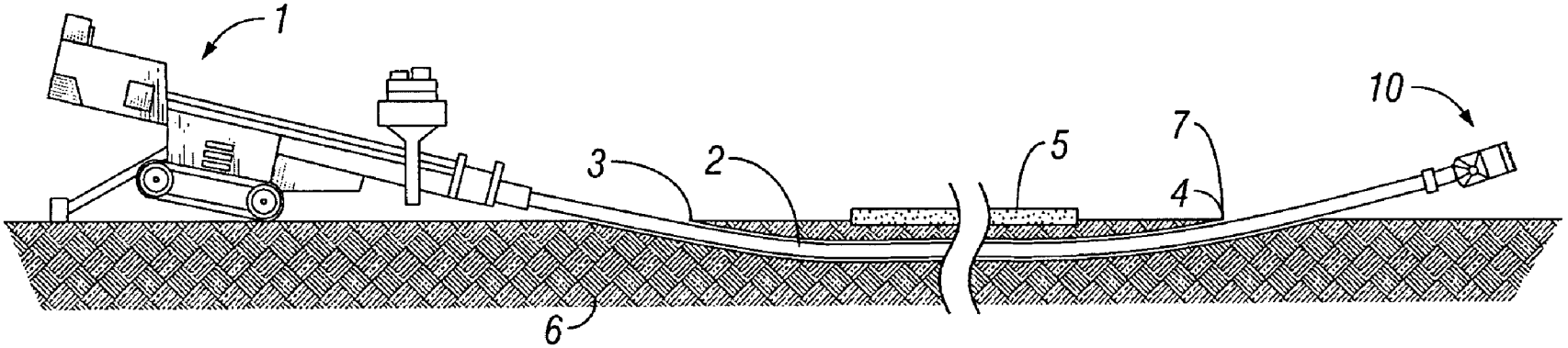
FIG. 1 shows an example of a back reaming tool according to one aspect of the invention being used to enlarge the diameter of a subsurface conduit.

FIG. 1 shows one embodiment of a back reaming tool 10 used with a horizontal drilling rig 1 to drill a subsurface conduit 7 in earth formations 6 underneath the position of an obstruction 5 at the earth's surface. In this example, the obstruction 5 is a roadway, but it should be clearly understood that the obstruction, and the type of drilling rig used are not intended to limit the invention. Generally speaking, the drilling rig 1 turns threadedly coupled segments of drill pipe 2 while pulling thereon, so that the back reaming tool 10 can enlarge the diameter of the conduit 7 as it traverses the span between an exit hole 4 and an entry hole 3 previously drilled using a conventional drill bit (not shown). The back reaming tool 10 is coupled to the drill pipe 2 generally at the position of the exit hole 4 and is then pulled along the conduit 7 as it is rotated to enlarge the diameter of the conduit 7. In some cases, the back reaming tool 10 can be pushed through a drill hole or conduit, but this is done only in special situations and is rare.

Figure 2:
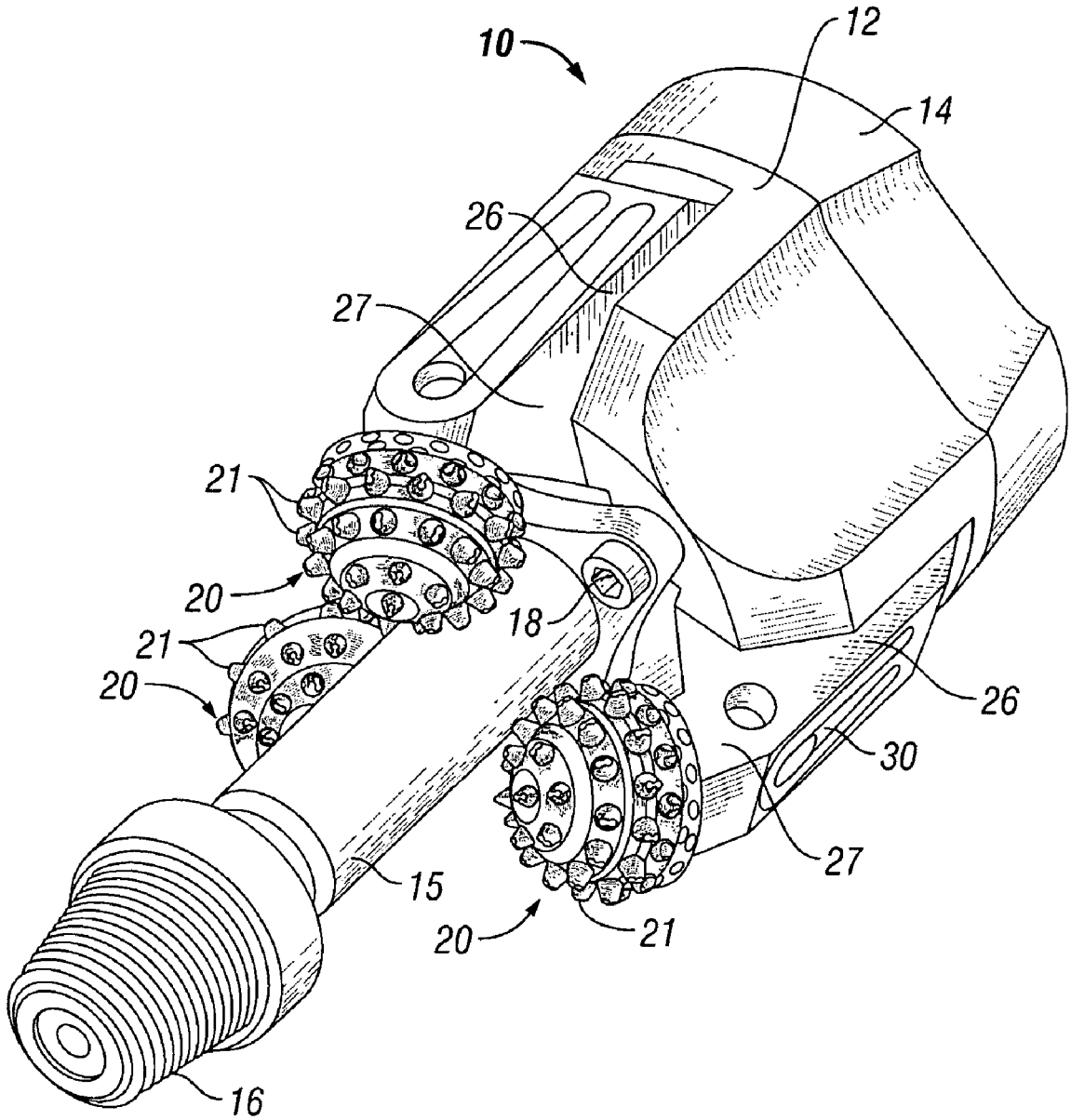
FIG. 2 shows one example of a back reaming tool according to one aspect of the invention.

An embodiment of the back reaming tool is shown in more detail in FIG. 2. The back reaming tool 10 includes a tool body 12 having a base end 14 and a coupling end 16. The base end 14 is coupled to the connector end 16 through a reduced diameter neck 15 which provides clearance for one of more cutting structures 26. In this example, the coupling end 16 has a male or "pin" type threaded connector to coupled the tool body 12 to the drill pipe (2 in FIG. 1) but it should be understood that other embodiments may use a female ("box") connector at the connector end 16, or may use other types of connections known in the art. Additionally, other embodiments may include a second connector, not shown, that is formed on the end of the back reamer opposite the first connector. The second connector may, for example, be used to pull conduit through the hole as the back reamer is used for cutting.

In the embodiment shown in FIG. 2, the tool body 12 includes a plurality of the cutting structures 26 each removably coupled to the tool body 12. Each such cutting structure 26 in this embodiment includes a leg 27 to which is rotatably mounted a roller cone 20. While FIG. 2 illustrates a back reamer with three legs, one of ordinary skill in the art would appreciate that the number of legs can increase or decrease from three without departing from the scope of the invention. Each of the roller cones 20 includes thereon a plurality of cutting elements 21 at selected positions about the surface of the roller cone 20. The cutting elements 21 can be of any type known in the art including milled steel teeth, inserts made of tungsten carbide or other metal carbide, superhard material such as boron nitride and diamond, or any combination thereof.

Other embodiments may contain a leg 27 with fixed type cutters in lieu of a roller cone. Fixed type cutters include blade type cutters, fixed cutters using polycrystalline diamond compact ("PDC") studs, fixed cutters using natural diamonds, or any other cutting structures known in the art. One of ordinary skill in the art would appreciate that a back reamer could be assembled with legs containing all of one type of cutting structure or combinations thereof.

Each leg 27 may also include a gage surface 30 to which may be affixed some type of gage protection (not shown in FIG. 2). The tool body 12 may include therein in this embodiment one or more hydraulic nozzles ("jets"—not shown) through which drilling fluid is discharged during drilling operations to clean and cool the back reaming tool 10 and to lift cuttings out of the conduit (7 in FIG. 1) as the back reaming tool 10 performs its task of enlarging the diameter of the conduit (7 in FIG. 1).

Figure 3:
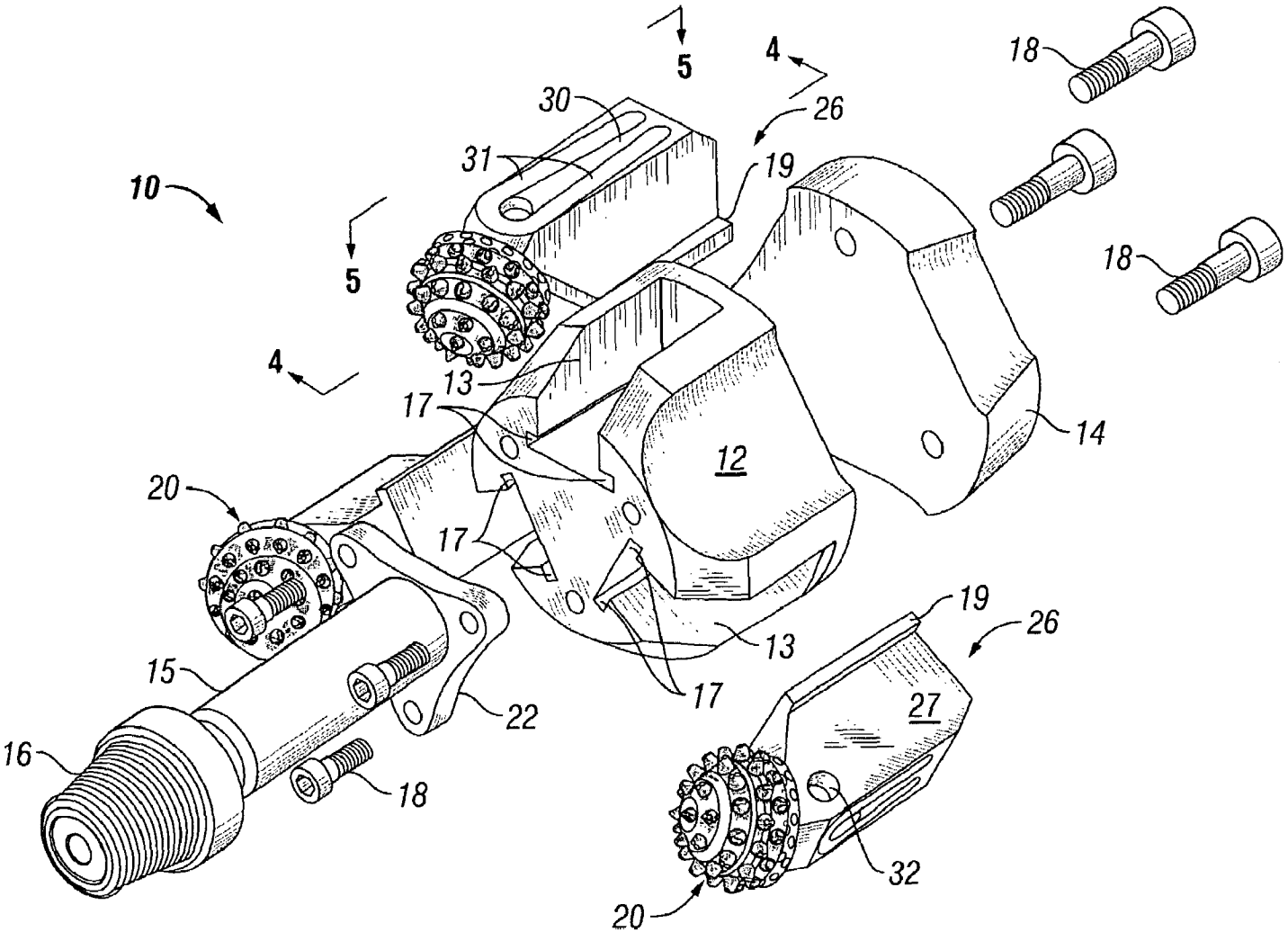
FIG. 3 shows an exploded view of the example back reaming tool of FIG. 2.

The embodiment of FIG. 2 is shown in exploded view in FIG. 3. The coupling end 16 and the neck 15 in this example may form a separate structure which may be removably mounted to the tool body 12 by a flange 22 secured to the tool body 12 such as by bolts 18. Removably mounting the coupling end 16 to the body 12 provides extra clearance to make it easier to remove the cutting structures 26 for servicing the back reaming tool 10. In the embodiment of FIG. 3, the base end 14 may also be removably attached to the tool body 12 such as by bolts 18. The cutting structures 26 may be secured to the tool body 12 in slots 13 adapted therefor by using one of the bolts 18 threaded into the base of each leg 27. In this embodiment, the slots 13 each include retention grooves 17 on the sides thereof which correspond to tongues 19 formed on the sides of each of the legs 27. Advantageously, the tongues 19 and corresponding grooves 17 retain the legs 27 laterally on the tool body 12, so that only bolt 18 is needed for axial restraint of each leg 27 to the tool body 12. Each leg 27 in this embodiment includes a lubricant access hole 32 drilled through a side thereof to load bearing lubricant of any type well known in the art.

FIG. 4 shows a cross-section of one of the cutting structures 26 of FIG. 2. The leg 27 includes a threaded hole 29 for receiving the mounting bolt (18 in FIG. 2) therein. The roller cone 20 is shown rotatably mounted on a journal pin 35. In the embodiment of FIG. 4, the cone 20 is shown as locked onto the journal pin 35 by retaining balls 36 in a retaining groove in the journal pin 35. The retaining balls 36 are loaded through a ball loading hole 39A which is subsequently closed by a plug 39 or the like after the cone 20 is mounted on the journal pin 35. It should be understood that other types of cone retention devices known in the art such as threaded locking rings may be used in any embodiment of a back reaming tool according to the invention. The cone retention device shown in FIG. 4 is therefore not meant to limit the scope of the invention.

The roller cone 20 is shown as being rotatably mounted to the journal pin 35 using a roller bearing 37. Other embodiments may use journal bearings having wear surfaces of any type well known in the art. The bearing 37, journal pin 35 and interior of the roller cone 20 are sealed to exclude dirt and drilling fluid therefrom by a seal 37A, which in this embodiment is an elastomeric seal. The interior of the roller cone 20, the journal 35 and the bearing 37 are lubricated by connection to a lubricant reservoir 34 drilled through and into the leg 27 structure. The reservoir 34 is preferably pressure balanced to the pressure outside thereof by a balancing piston 33 of any type well known in the art for pressure balancing drill bit lubricant reservoirs. Lubricant may be loaded through the access hole 32, or through the reservoir 34 directly prior to inserting the balancing piston 33.

As previously explained, the exterior surface 30 of each leg 27 may include some form of wear protection 31 thereon. One example of such wear protection is shown in FIG. 5. The wear protection 31 may be a layer of hardfacing such as tungsten carbide or the like applied by any well known process to the exterior surface 30 of the leg 27.

Figure 6:
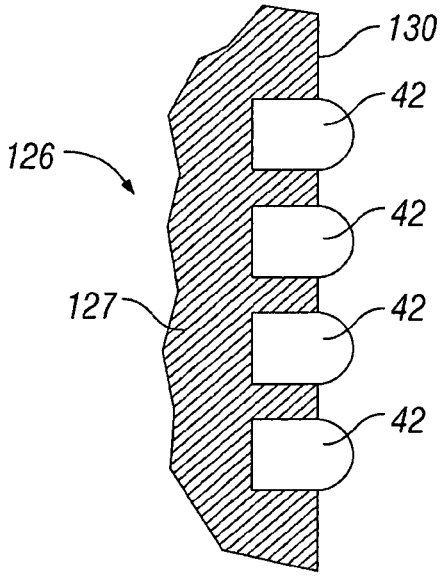
FIG. 6 shows an alternative type of gage protection in cross section.
Figure 7:
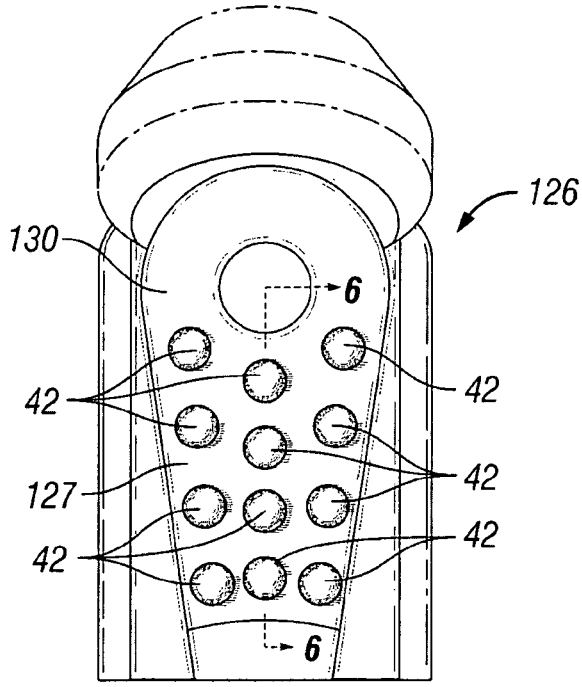
FIG. 7 shows the alternative gage protection of FIG. 6 in side view of a cutting structure.

An alternative form of wear protection to the exterior leg surface is shown in FIGS. 6 and 7. FIG. 6 shows a cross section through the leg 127 of one of the exterior surfaces 126 having the alternative form of wear protection. The wear protection in this embodiment includes one or more buttons 42, which may be formed from a hard material, typically a metal carbide such as tungsten carbide, a superhard material such as natural or synthetic diamond or cubic boron nitride, or any combination thereof, mounted in the exterior surface (130 in FIG. 7) of the leg 127. The buttons, shown in side view in FIG. 7 may be disposed in any suitable arrangement about the exterior surface 130 to protect the exterior surface 130 from wear during operation.

Figure 8:
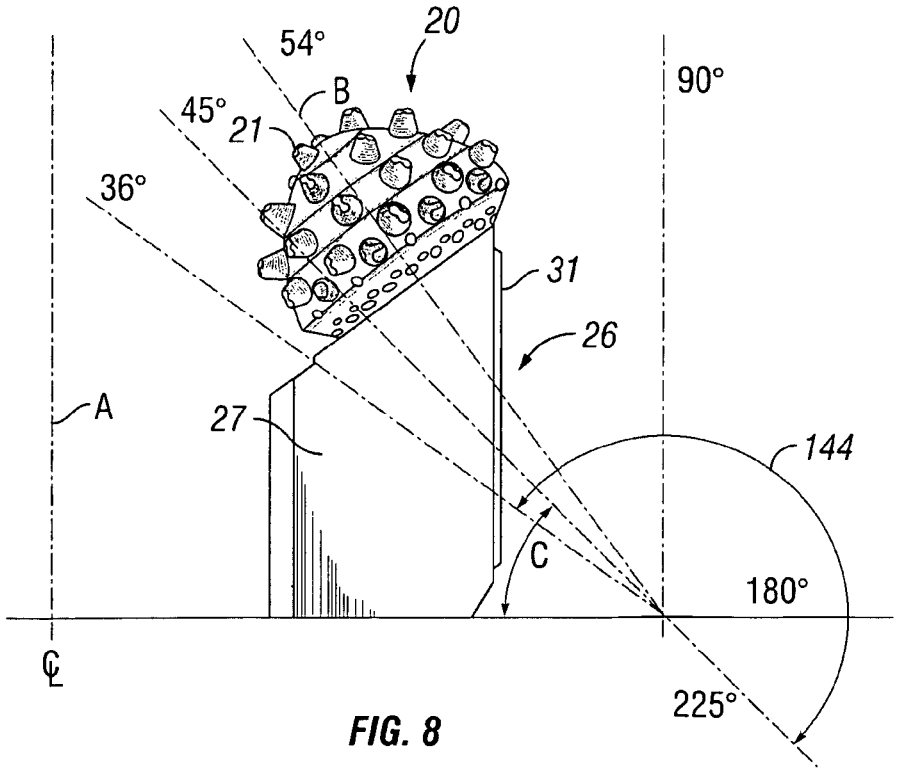
FIG. 8 shows an example of preferred journal angles for the cutting structures on the example back reaming tool of FIG. 2.

FIG. 8 shows one aspect of various embodiments of a back reaming tool made according to the invention. An angle C is defined between a line, indicated by 0 degrees, perpendicular to a centerline A of the tool body (12 in FIG. 2) and a rotational center line B of the roller cone 20. A suitable range 144 for angle C is between about 36 degrees and 225 degrees. More preferably, the range 144 is between 40 and 60 degrees, and most preferably, angle C is about 54 degrees.

Figure 9:
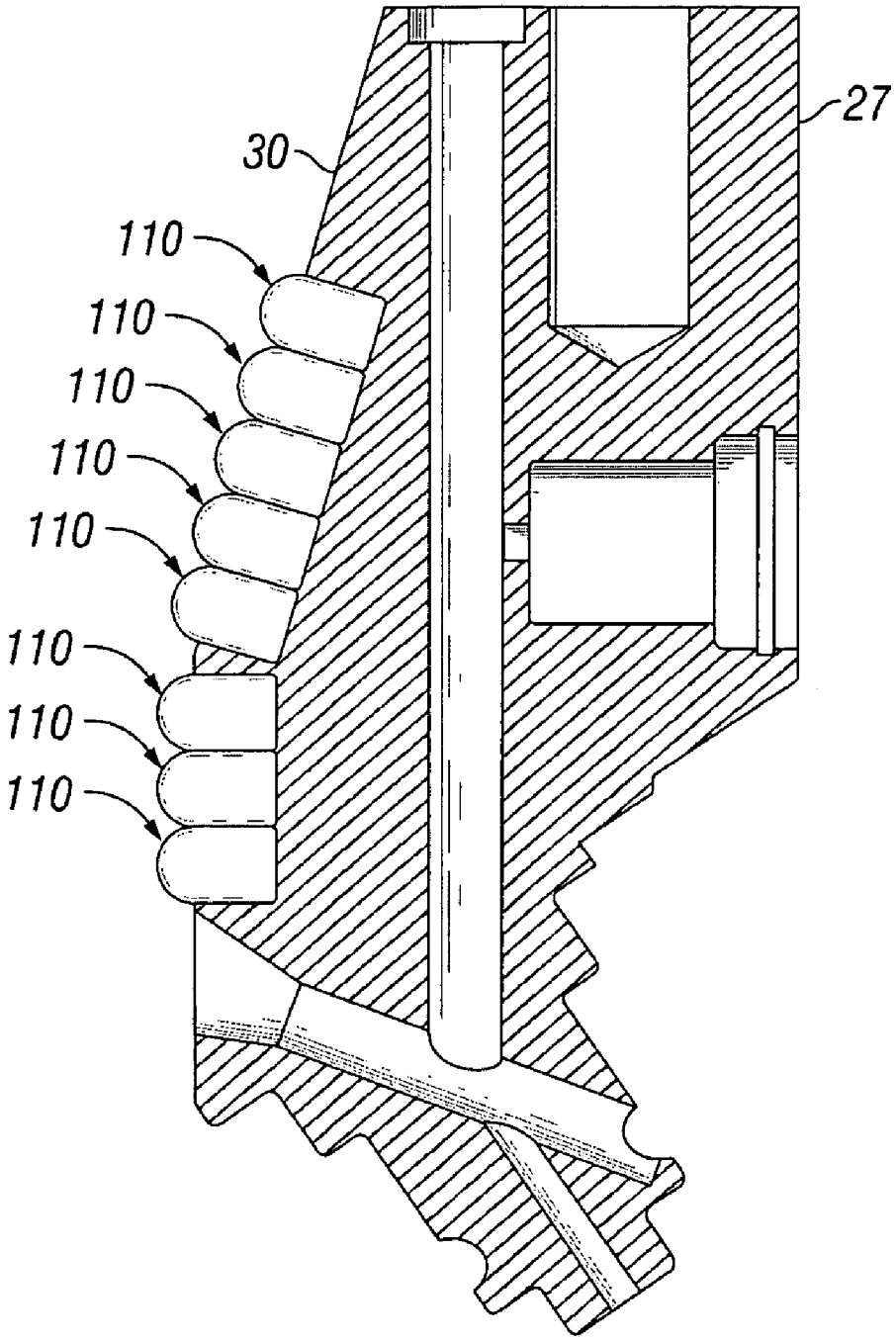
FIG. 9 shows an alternative cutting structure which uses both fixed cutters and a roller cone cutting structure thereon.

A cross-section of another embodiment of the legs 27 is shown in FIG. 9. The exterior surface 30 in this embodiment may be sloped or tapered in a direction opposite the normal reaming direction of the tool (10 in FIG. 1). The sloping portion may include a number of supplemental cutting elements 110 which may be inserts made from metal carbide such as tungsten carbide, superhard material such as diamond or boron nitride (including cubic boron nitride), or any combination of these. If during operation it should become necessary to move the tool 10 in a direction opposite the normal direction of reaming (meaning toward the exit hole 4 in FIG. 1), the supplemental cutting elements 110 may make it easier to move the tool 10 in the opposite direction in the event the conduit (7 in FIG. 1) caves in or otherwise becomes smaller in diameter.

Figure 10:
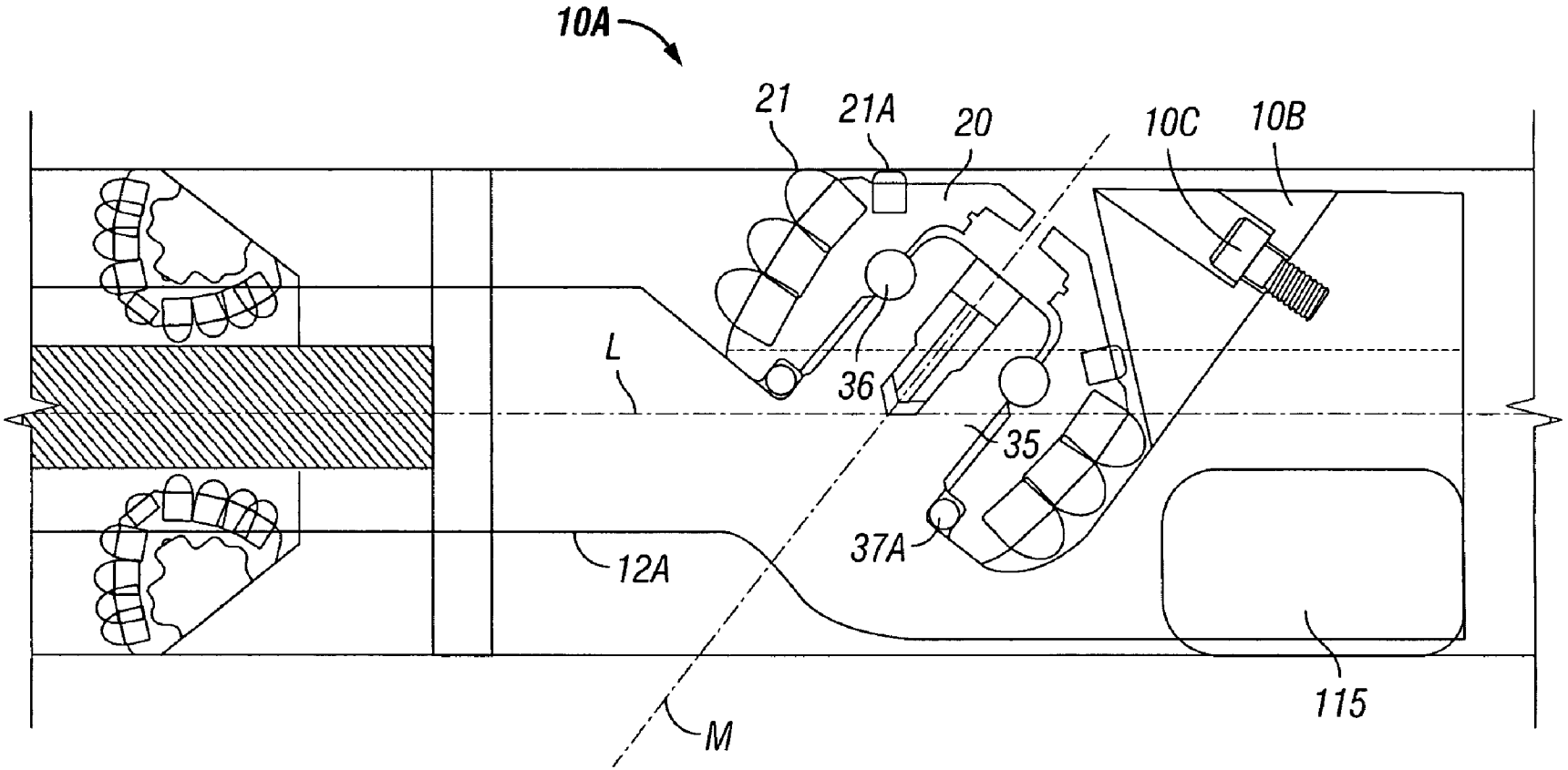
FIG. 10 shows a cross section of an alternative back reaming tool specially intended for use in small diameter conduits.

Another type of back reaming tool is shown generally in cross sectional view in FIG. 10. This type of back reaming tool 10A includes a tool body 12A for coupling to the drill string (2 in FIG. 1) in a manner similar to that of the previous embodiments. The tool body 12A includes a single journal pin 35 formed therein, to which is rotatably mounted a roller cone 20 of any type known in the art, and retained thereon using retaining balls 36, or any other locking device known in the art, and sealed by seal 37A. The roller cone 20 of the embodiment in FIG. 10 may include any type of cutting elements 21 as in previous embodiments, and gage cutting elements 21A of types well known in the art and disposed substantially as shown in FIG. 10 close to the apex of the roller cone 20. The roller cone 20 will drill a hole having the needed diameter by traversing a radius with respect to the tool centerline L. When the tool is rotated about centerline L the roller cone 20 will enlarge the conduit (7 in FIG. 1) to about twice the roller cone radius from the centerline L. The lateral position of the tool body 12A in the conduit (7 in FIG. 1) may be stabilized using a roller or other type stabilizer, shown generally at 115. In this embodiment, the roller cone 20 may be secondarily retained in the event of bearing and/or retaining ball 36 failure by a cone lock 10B coupled by a cap screw 10C or the like to the tool body 12A. In the embodiment shown in FIG. 10, the rotational axis of the cone M preferably subtends and angle of about 40 degrees with respect to the centerline L.

Figure 11:
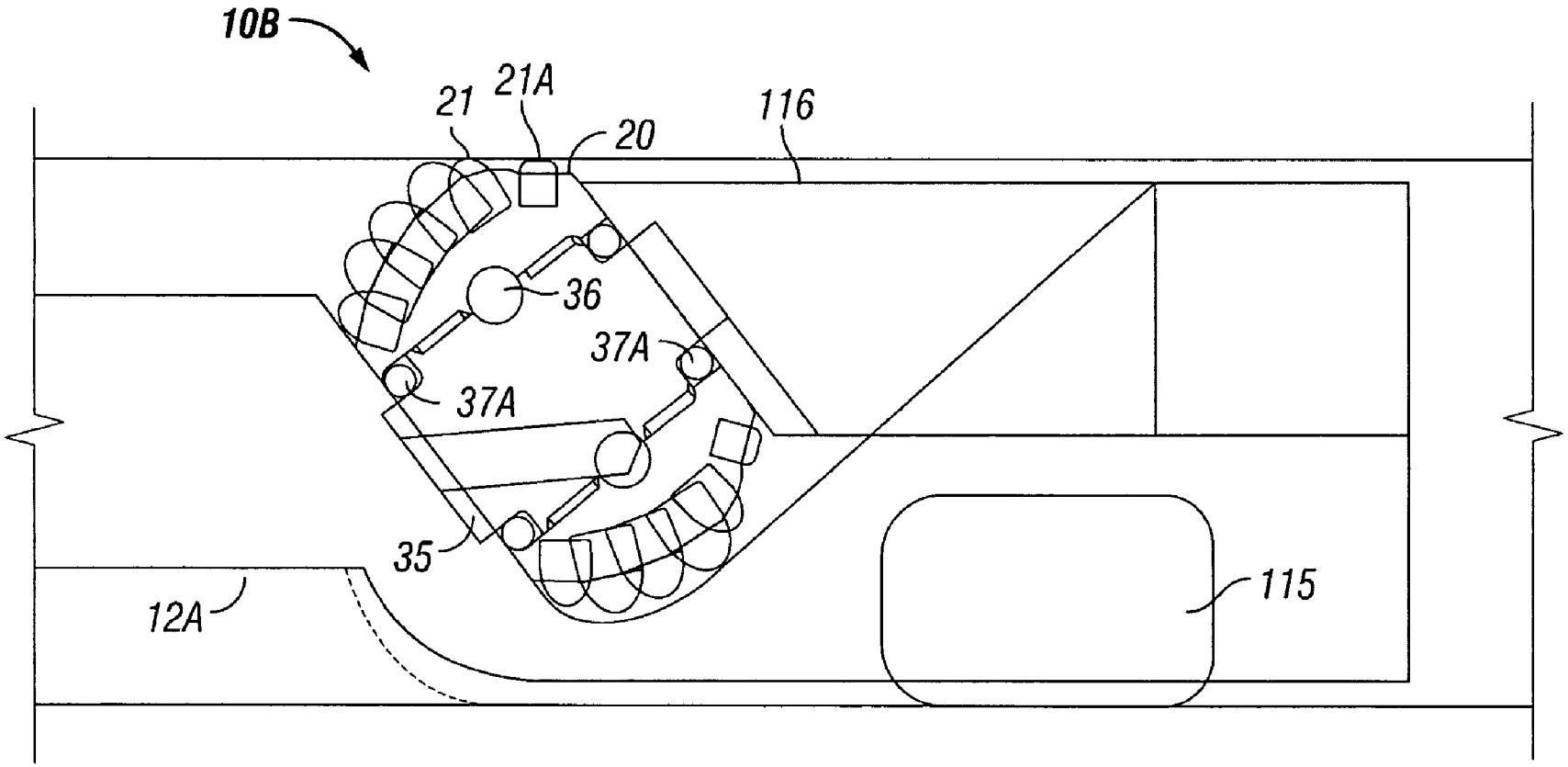
FIG. 11 shows an alternative form of the small-diameter back reaming tool of FIG. 10.

An alternative embodiment of a single cone back reaming tool is shown in FIG. 11. The alternative embodiment back reaming tool 10B includes a single roller cone 20 rotatably mounted on a journal pin 35 coupled to or formed as part of the tool body 12A. As in the previous embodiment, the tool body 12A includes thereon a roller stabilized 115 on a side opposite the cone 20. In this embodiment, the roller cone 20 is retained on the journal pin 35 by locking balls 36, but it should be understood that other types of cone retention devices may be used in other embodiments of a back reaming tool according to this aspect of the invention.

This embodiment of the back reaming tool 10B includes a journal retainer 116 disposed on one end of the journal pin 35. The journal retainer 116 may be removably affixed to the tool body 12A so that by removing the journal retainer 116, the roller cone 20 may be removed from the journal pin 35. In some embodiments, the journal pin 35 itself may be removable from the tool body 12A after removing the retainer 116 and cone 20. Using the journal retainer as shown in FIG. 11 requires that the roller cone 20 be open at both ends along the axis of rotation. Therefore, the roller cone 20 includes a provision for sealing the journal at both ends thereof, which is shown in FIG. 11 as including seals 37A at both axial ends of the cone 20. As in other embodiments of the back reaming tool, the cone 20 includes thereon a plurality of cutting elements 21, which may also include gage cutting elements 21A. The cutting elements 21 may be milled steel teeth, inserts made from tungsten carbide, other carbide, superhard material or any combination thereof.

Figure 12:
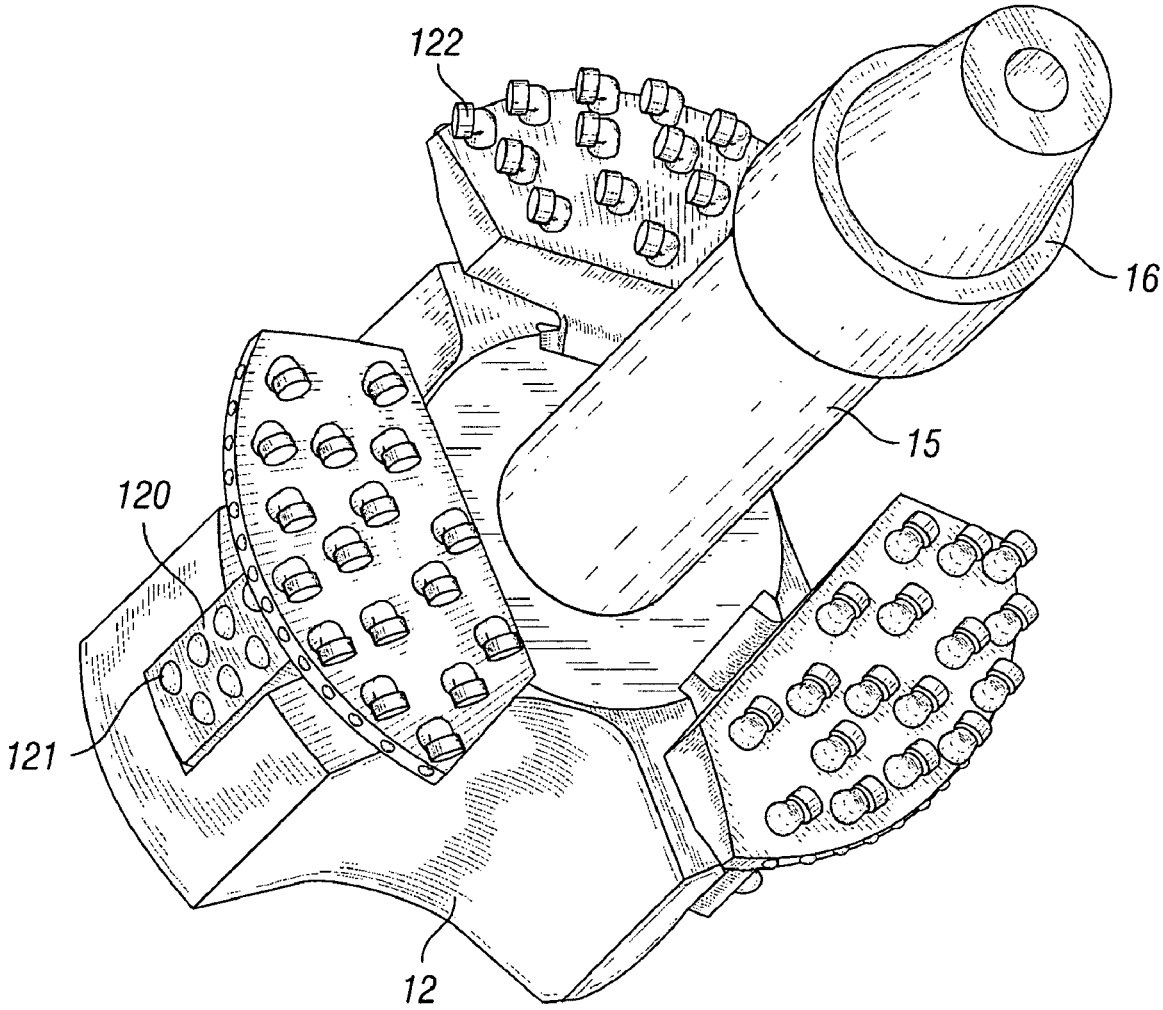
FIG. 12 shows an example of a back reaming tool in accordance with one embodiment of the present invention.

FIG. 12 illustrates an embodiment of the invention employing legs with fixed cutters. A fixed cutter leg 120 is removably attached to the tool body 12. In this example, three fixed cutter legs 120 are removably attached to the tool body 12, but the quantity of fixed cutter legs may vary. The fixed cutter legs 120 could be secured to the tool body 12 by a similar method as shown in FIGS. 2 and 3.

Figure 13:
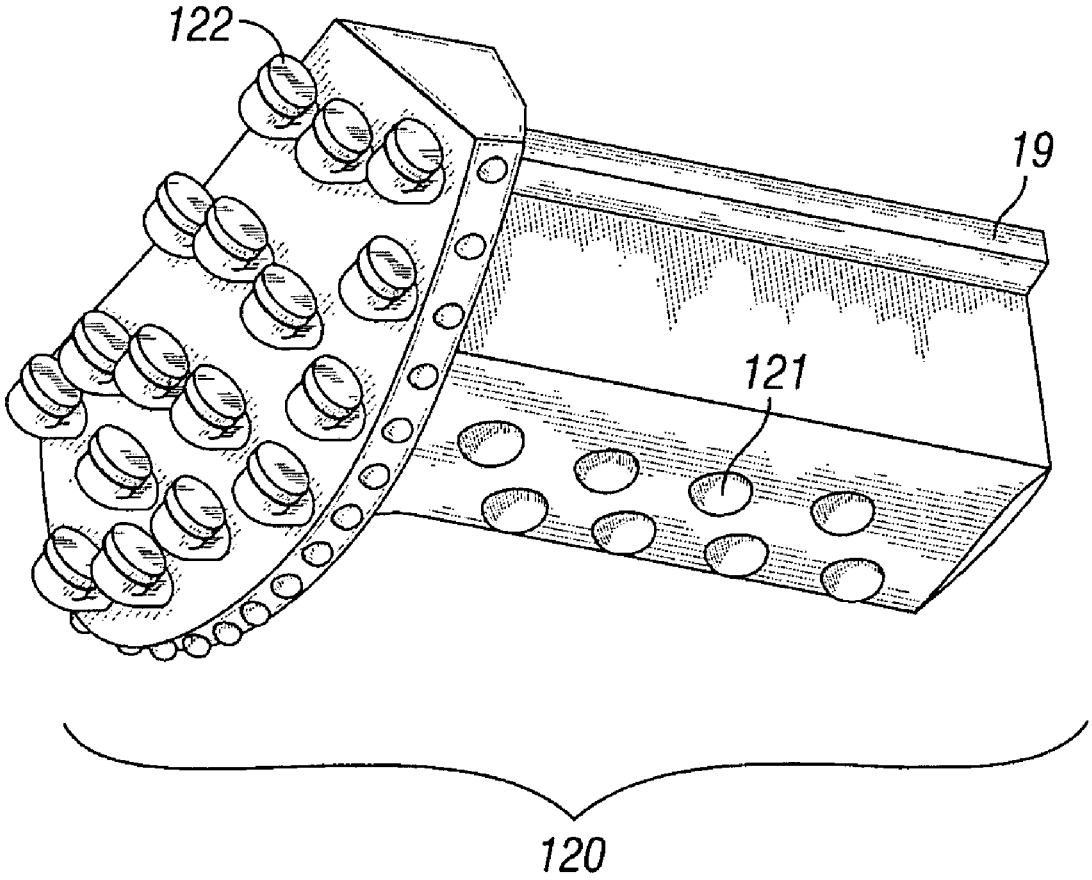
FIG. 13 shows one leg of the back reaming tool of FIG. 12.

In the embodiment shown in FIG. 12, each fixed cutter leg 120 includes a plurality of cutting elements 122. In some embodiments, wear protection, such as buttons 121, might be included on the exterior surface of the fixed cutter leg 120. In FIG. 13, a fixed cutter leg 120 is shown in accordance with one embodiment of the invention. The fixed cutter leg 120 includes a tongue 19 similar to the previously discussed legs having roller cones. In some embodiments of the invention, various sizes and designs of legs might be adapted to use the same tool body.

Embodiments of the present invention provide one or more of the following advantages. The legs containing the cutting structures may be replaced with standard tools. This removes the need for reworking by a manufacturer and instead allows for replacement by operators in the field. The ability to replace legs in the field allows operators to vary the cutting structures based on the parameters of the hole. An operator could, for example, believe that the geology suggested that roller cones would provide optimal cutting. Upon drilling the initial hole, this knowledge could be found to be erroneous and require that different cutters be utilized. The legs with roller cones could then be replaced in the field with fixed type cutters.

Moreover, the type of cutters could be varied within each assembly to provide optimal cutting for the actual conditions of the hole. The operator could desire that the back reamer have one fixed cutter with PDC studs, one fixed blade type cutter, and one roller cone. The removable legs of the back reamer allow for the variation of the cutting structures as desired by the operator. This may improve the cutting performance of the back reamer.

As discussed above, one or more of the legs may have a gage surface. The gage surface functions as an integral stabilizer. The integral stabilizer helps to maintain the proper axial relationship to the borehole while the back reamer is in operation. Stabilizers wear while in use. When the cutters wear and require replacement, new legs will provide new cutters. The replacement of the legs also provides new stabilizers. This allows for the stabilizers to match the wear of the cutters without requiring separate replacement of the stabilizers.

Another aspect of the invention that provides an advantage is the ability to use any type of bearing system known in the art to mount a roller cone on a leg. This functionality allows for an operator to select bearings based on the parameters of the hole to be back reamed. The operator could, for example, choose between a sealed and non-sealed bearing system for the roller cone based on the length of the hole and the time in the hole. The additional flexibility allows for suitability of the back reamer for additional applications.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A back reaming tool comprising:

a tool body adapted to be coupled to a drill string; and at least one cutting structure mounted to a leg and having cutting elements disposed thereon, wherein the leg is removably coupled to the tool body.

2. The back reaming tool of claim 1, wherein an integral stabilizer is formed on the leg.

3. The back reaming tool of claim 1, wherein the cutting elements are polycrystalline diamond compact studs.

4. The back reaming tool of claim 1, wherein the cutting elements comprise natural diamonds.

5. The back reaming tool of claim 1, wherein the at least one cutting structure is fixed with respect to the leg.

6. The back reaming tool of claim 1, wherein the at least one cutting structure is a roller cone rotatably mounted to the leg and having cutting elements disposed thereon.

7. The back reaming tool of claim 6, wherein an axis of rotation of the roller cone subtends an angle in a range of about 36 to 225 degrees from a line perpendicular to a center line of the tool body.

8. The back reaming tool as defined in claim 7, wherein the angle is in a range of about 40 to 50 degrees.

9. The back reaming tool as defined in claim 7, wherein the angle is about 54 degrees.

10. The back reaming tool as defined in claim 1, wherein the tool body comprises a removable coupling end adapted to couple the tool body to the drill string.

11. The back reaming tool as defined in claim 1, wherein the leg comprises tongues thereon adapted to fit in mating grooves in the tool body, the tongue and grooves adapted to laterally retain the leg on the tool body.

12. The back reaming tool as defined in claim 1, further comprising wear protection on an exterior surface of the leg.

13. The back reaming tool as defined in claim 12, wherein the wear protection comprises hardfacing applied to the exterior surface of the leg.

14. The back reaming tool as defined in claim 12, wherein the wear protection comprises at least one button affixed to the exterior surface of the leg.

15. The back reaming tool as defined in claim 14, wherein the at least one button is formed from at least one of metal carbide, diamond, boron nitride and combinations thereof.

16. The back reaming tool as defined in claim 1, further comprising a tapered exterior surface on the leg, the tapered exterior surface including thereon at least one supplemental cutting element.

17. The back reaming tool as defined in claim 16, wherein the at least one supplemental cutting element is formed from at least one of metal carbide, diamond, boron nitride and combinations thereof.

18. A back reaming tool comprising:

a tool body adapted to be coupled to a drill string, wherein the tool body provides a plurality of slots, each configured to receive a leg assembly;

wherein the leg assemblies provide a cutting structure having cutting elements thereon; and wherein the leg assemblies are removably coupled to the plurality of slots.

19. The back reaming tool of claim 18, further comprising:

retention grooves in the plurality of slots;

tongues on the leg assemblies; and wherein the leg assemblies are retained within the tool body by the by the tongues and the retention grooves.

* * * * *